US007150290B1

(12) United States Patent
Smith

(10) Patent No.: US 7,150,290 B1
(45) Date of Patent: Dec. 19, 2006

(54) UNITARY CONCRETE PUMPING STATION FOR AQUEOUS WASTE SUBMERSIBLE PUMPING APPLICATIONS

(75) Inventor: Frank J. Smith, Broad Brook, CT (US)

(73) Assignee: Electric Technologies, Inc., Bloomfield, CT (US)

( * ) Notice: Subject to any disclaimer, the term of this patent is extended or adjusted under 35 U.S.C. 154(b) by 13 days.

(21) Appl. No.: 11/059,664

(22) Filed: Feb. 17, 2005

(51) Int. Cl.
*F16L 5/00* (2006.01)
*E02D 29/14* (2006.01)

(52) U.S. Cl. ..... 137/363; 137/236.1; 137/372; 137/565.33; 137/576; 137/590.5; 52/21

(58) Field of Classification Search ..... 137/236.1, 137/363, 372, 565.33, 576, 585, 590.5; 52/20, 52/21

See application file for complete search history.

(56) References Cited

U.S. PATENT DOCUMENTS 163,541 A * 5/1875 Hirst ..... 37/306
1,148,500 A * 8/1915 Caverno ..... 210/294
2,396,102 A * 3/1946 Jackson et al. ..... 122/1 A
3,396,102 A * 8/1968 Forrest ..... 210/624
4,049,013 A * 9/1977 Shenk ..... 137/263
4,576,197 A * 3/1986 Kempers ..... 137/565.17

* cited by examiner

*Primary Examiner*—A. Michael Chambers
(74) *Attorney, Agent, or Firm*—Stephen W. White

(57) ABSTRACT

A unitary concrete structure pumping station useful in pumping waste fluids and the like during the passing of such materials from one part of a gravity flow waste system to another. This concrete structure is simple to install and use and many of the problems associated with conventional pumping stations are alleviated. The structure is comprised of several parts that can be made pre-assembled at the factory or assembled in the field prior to installation. By being a unitary structure this pumping station is resistant to movements within the earth and therefore less likely to incur line breaks.

8 Claims, 8 Drawing Sheets

25
39b
61
39a
60
7
39a
25
39
27
60
36
52
38
6
3
8
53
9
50
4
5
10
10a
37
11
40a
40

UNITARY CONCRETE PUMPING STATION FOR AQUEOUS WASTE SUBMERSIBLE PUMPING APPLICATIONS

BACKGROUND OF THE INVENTION

1. Field of the Invention

This invention relates to the fields of waste and storm water pumping and waste product management and more particularly to the means of pumping such waste materials into a pressurized pipe and further on into a gravity sewer waste handling system for further treatment and processing. More particularly, this invention relates to gravity flow waste handling systems. Still more particularly, this invention relates to an improved pumping stations for such waste handling and to a unitary structure employed as a system with submersible pumping systems or pump stations. Even more particularly, this invention relates to pumping stations that can be installed within the flow and area of vehicular traffic.

2. Description of the Prior Art

Most commercial waste handling systems usually employ some sort of gravity flow to carry the waste along a piping system and subsequently to treatment or other handling systems. Many of these systems are aqueous flow systems that handle sewage and other aqueous waste products including storm water run off and the like. It is difficult, however, to provide a total gravity flow system and it is sometimes necessary to have one or more pumping stations within the waste handling flow areas in order to move the waste stream along to its ultimate destination. For example, the waste from a higher source can flow along the piping or drainage system for a period of time but usually has to be pumped up over to some higher elevation. These pumping stations are very common within the prior art and usually employ a collection point in which a submersible pump is placed. As the collection point fills up with the aqueous waste product the pump sends this material up into an internal piping system through a check valve and into a gate valve apparatus and the pipe from thence sends the waste product on its way to the next point. There may be, and in fact usually are, several of these pumping stations between the aqueous waste source and the ultimate destination, which may be a waste treatment facility or just some drain source for normal storm drains and the like. Additionally, it is sometimes requisite to install a pumping station under the street or highway area in order to pump storm water and the like.

There are some serious problems with current pumping stations within the prior art. Most of these systems are round, concrete elements and are furnished as at least two or more, separate elements. Such a dual element includes the collection or pumping container (commonly called a wet well) and the container or chamber and the container or chamber for the valves and other elements (commonly called a valve chamber). They are inserted under ground in such a manner that the collection point containing the submersible pump is deeper than the container for the valves. In between these two, cementitious containers or chambers, there is normally a line or pipe to move the waste from the collection point to the valve chamber. Since the ground must be disturbed during the installation of these two points there is a tendency for the disturbed ground to settle and this settling causes movement of the piping between the collection point and the valve chamber and occasionally a line break occurs. This line breakage is a serious event and it is always necessitates the need to excavate the area around and between the two points in order to get to the line for repair. This is a very costly step and when there are several such pumping stations and several such line breaks the costs elevate considerable. Additionally, any leaks that may occur around these pumping stations can result in ground water pollution. Most of the current pumping stations are not suitable for installation under streets and the like since they must survive the constant flow of vehicular traffic without cracking lines and the like.

There is also considerable installation costs incurred by using these prior art pumping stations. Considerable ground must be excavated and putting together the two chambers or containers is time consuming and sometimes dangerous. As mentioned previously, it is difficult to sufficiently compact the ground around the containers and thus the shifting and/or settlement problems occur as previously mentioned. The two or more container system is also complicated requiring a great deal of skill to construct. Also, since the valve chamber or container is smaller in size it tends to "float" and/or "sink" in the disturbed ground area causing additional strain such as shears and breaks on the piping system.

Finally, since the two container or chamber system is more complicated, the construction of pumping stations using these prior art systems is also very complicated and requires a lot of individual parts. Thus, the installer must have on hand a great variety of elements and this is very expensive.

SUMMARY OF THE INVENTION

There is a pressing need or object within the prior art for a unitary pumping station for pumping aqueous waste or storm materials from one level to another. There is also a pressing need or object within the prior art for a pumping station that can be installed without fear of breakage when the disturbed ground moves after installation. Finally, there is also a pressing need or object for a pumping station that can be manufactured usually in a single pieces with the requisite parts and elements already installed and so as to permit joining of these pieces, especially in larger systems, of chambers right on the site. There is also a need to provide smaller systems that can be entirely manufactured away from the installation site and thus improve installation thereof. This will reduce the time requisite for installation thereof. Also, there is a pressing need to have a secure and safe pumping station that can be installed underground in streets and the like and that will survive vehicular traffic that passes overhead. These and yet other objects are achieved in a unitary cementitious pumping station for moving aqueous waste materials from one level to another comprising in order, a. a squared fluid receiving container having a bottom with integral filets, four sides and a top with an inlet on one side, an exit line on the side opposite to said inlet and wherein said exit line is attached to a submersible pump contained therein;

b. a smaller and squared valve container having a bottom, four sides, a top wherein said top is essentially at the same level as the top from said receiving container, and a exit line on one side, said smaller container attached to the exit line side of said receiving container, and wherein said exit line in said smaller container is on the side opposite to the side attached to said receiving container, a fluid transit line attached to said exit line from said receiving container and to said exit line in said smaller container, and wherein said smaller container also contains at least one valve within said attaching line, so that when aqueous waste enters said receiving container and begins to fill up said receiving container, said pump will pump said aqueous waste up through said exit line contained therein and through said fluid transit line and said valve and out said smaller container exit.

BRIEF DESCRIPTION OF THE DRAWINGS

FIG. 8 is the same as the element of FIG. 7 except for the addition of a flume container in place of a catch-type container.

FIG. 8*a* shows the flume container in more detail as.

DETAILED DESCRIPTION OF THE INVENTION

Figure 1:
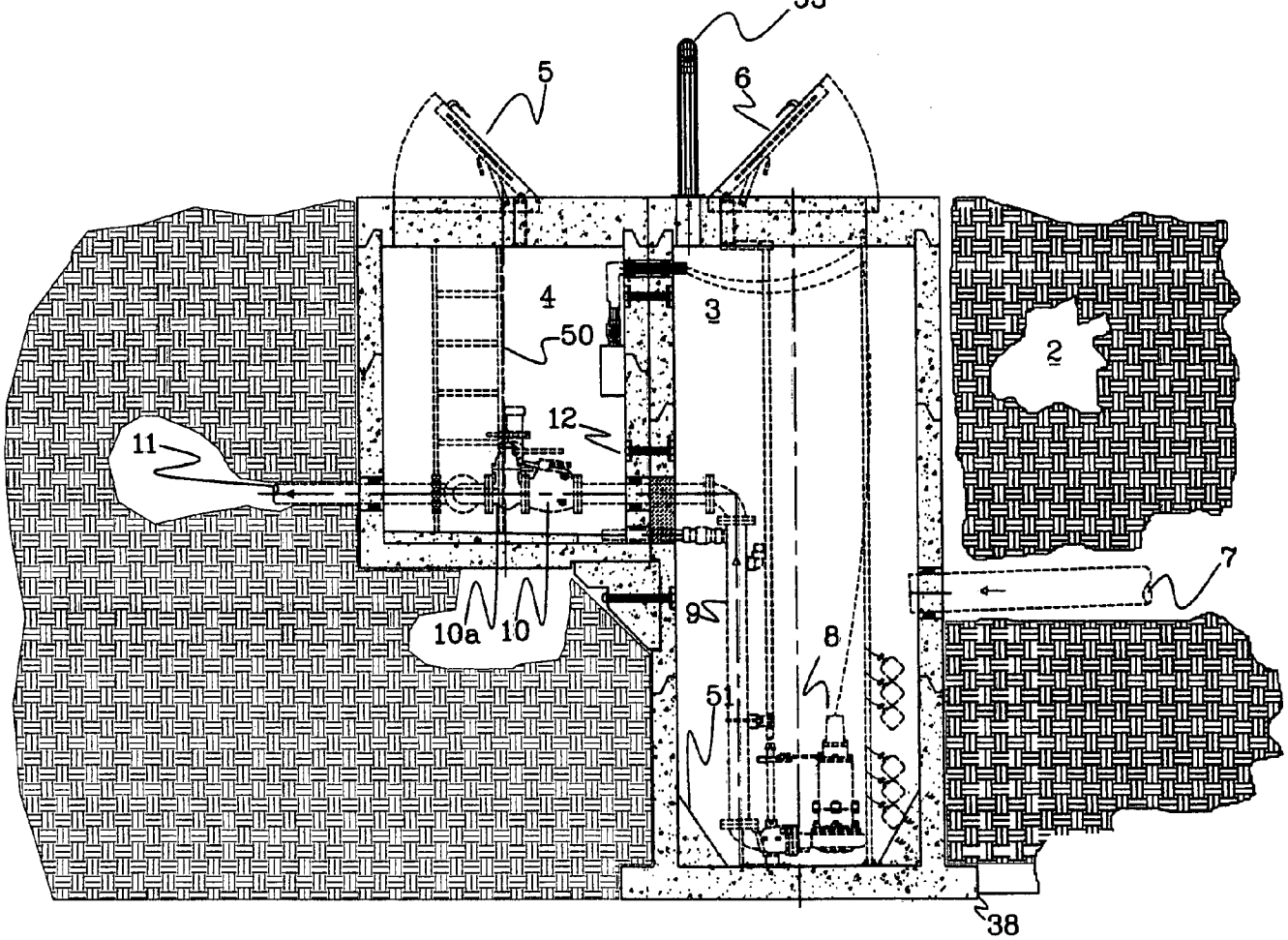
FIG. 1 is a side view of the basic design of the unitary, cementitious, squared pumping station of this invention.

Looking now specifically at the drawings particularly useful in describing this invention, but by which I am not limited, FIG. 1 is a basic and simple form of the unitary pumping station useful in moving waste fluids from one level to another. In this showing 1 is the unitary pumping station as a whole shown beneath the ground 2. A squared, fluid receiving container is shown as 3 and a smaller, squared valve container shown as 4. Each of these two containers may have a man-hole access point as shown as 5 and 6. In the fluid receiving container the fluid enters in at a certain level through inlet pipe 7. As the fluid rises up in this container a submersible pump 8 pumps this fluid up into the smaller valve container 4 through a pipe 9. This fluid passes through an integral check valve 10 and then through a gate valve 10*a* and exits through pipe 11 further into the system. The entire system is a unitary pumping station with fluid entering at a lower level and being pumped into a higher level to continue down the system. An optional ladder 50 is shown in the valve container so as to give access to the valves when a shut-down is required, for example. Both 3 and 4 are mated together as will be described in a later figure. This mating then forms the unitary pumping station 1. Two of several mating bolts are shown as 12 and 12*a*. A vent pipe 53 is shown to ensure that any noxious gases are removed from the unitized structure of this invention. A pair of pumps and a pair of check and gate valves may be employed in this system.

Figure 2:
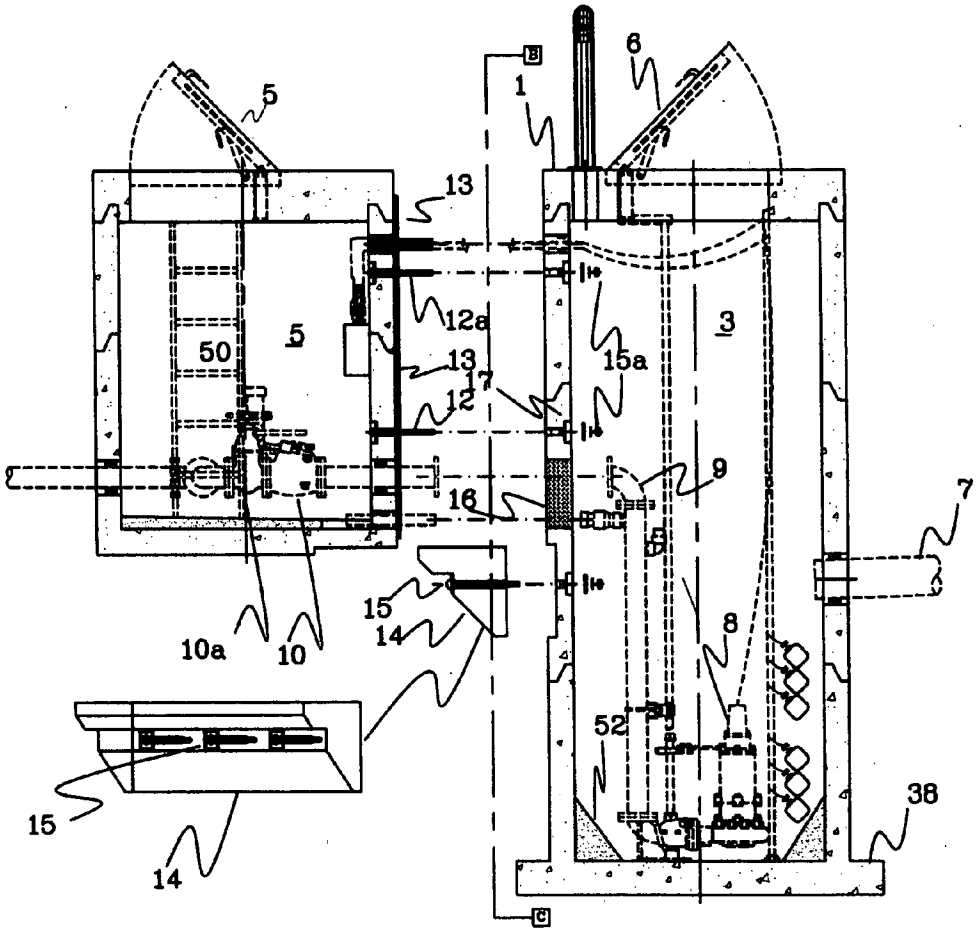
FIG. 2 is another side view of the element of FIG. 1 showing the various necessary connections to make the system unitary.

FIG. 2 is another view of the simpler, unitary pumping station from FIG. 1 shown in an exploded side view so as to demonstrate the various elements and as to how they can be constructed and mated or joined in situ. In this particular figure the ground is not shown. Once again, 3 is the fluid receiving container and 4 is the smaller valve container. These two containers are joined together following the dotted line A and two of several bolts are shown as 12 and 12*a*. A gasket 13 is furnished between the two containers in order to provide a tight seal. A supporting block is shown as 14 and this is connected to fluid receiving container 3 with several bolts, one of which is shown as 15. The connection of pipe 9 is made via an opening 16 in the side wall 17 of fluid receiving container 3 that adjoins the valve container 4. All of the connections can be made at the site as the various parts of the novel pumping station of this invention is assembled and installed. All insure a tight fit when so assembled to form the unitary element so useful as an aqueous waste pumping station. A front view of this supporting block 14 is shown in more detail with 3 bolt elements 15, 22 and 23. The supporting block will support the valve chamber securely preventing any torque or other forces that plague the prior art elements and cause severe problems during operation of the system.

Figure 3:
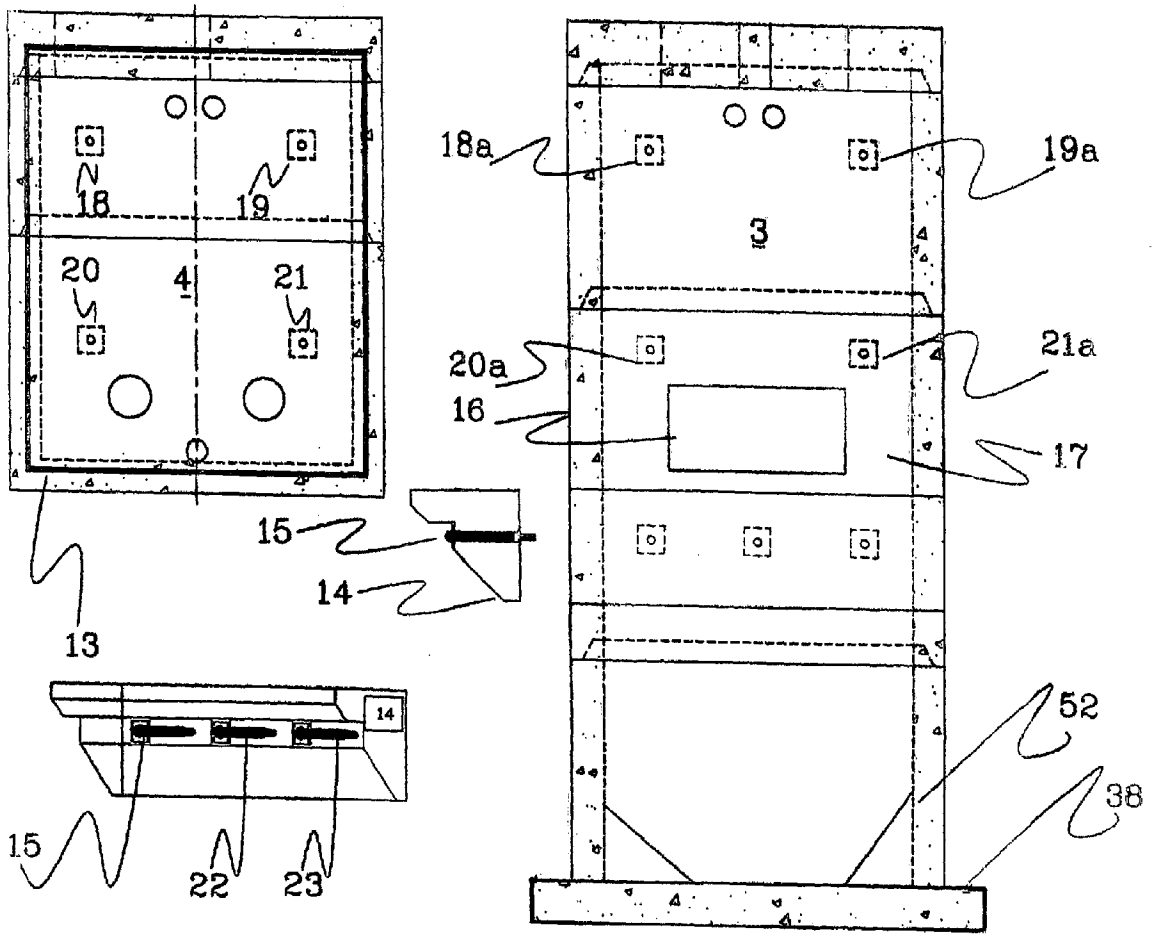
FIG. 3 is a view along the line B—C in FIG. 1 showing some detail of the connection of the parts needed to make the system unitary.

FIG. 3 is a showing of the connecting side walls taken along the dotted line B—C from FIG. 2. In this particular figure, the valve, submersible pump and various inlet and outlet pipes are not shown. The opening 16 in the side wall of the fluid receiving container 3 is shown as well as gasket 13. Bolt receiving holes within the valve container 4 are shown as 18, 19, 20 and 21 and these match up with bolt receiving holes 18*a*, 19*a*, 20*a* and 21*a* in the fluid receiving container 3. Bolts passing through from one container to the other can be used to pull the containers tight against each other. The supporting block 14 with one bolt 15 along with at least 2 other bolts 22 and 23 can be installed under the valve container 4 to provide support therefore. One of several filets in the bottom of the fluid receive container 3 is shown as 53. These concrete filets are useful in the management of solids found within the fluid entering this container.

Figure 4:
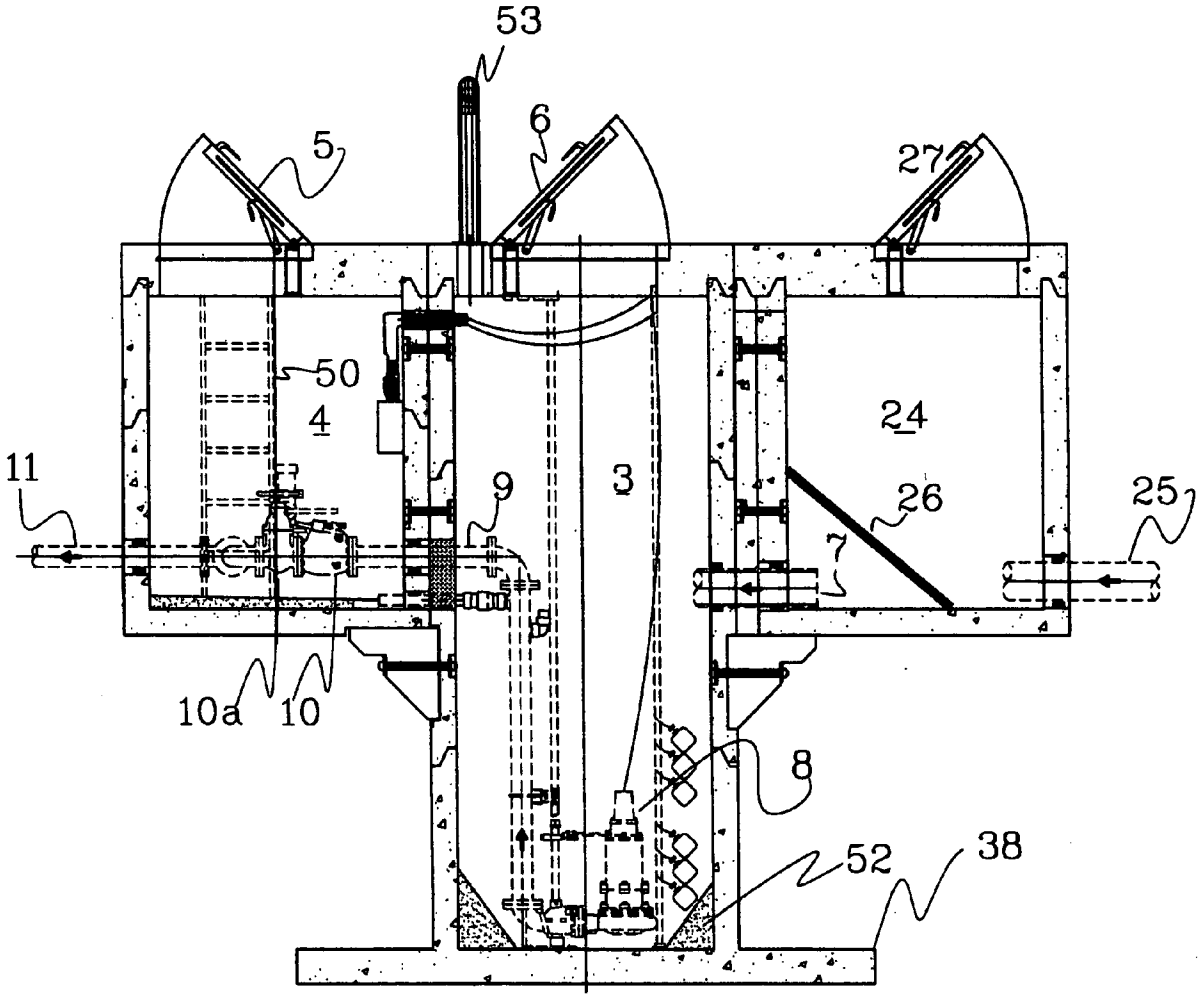
FIG. 4 is another embodiment of the unitary pumping station of this invention showing a catch-type container prior to the entry point of the waste fluids.

FIG. 4 shows yet another embodiment of the unitary pumping station of this invention. In this figure an inlet trapping container 24 is shown. This container is designed to trap larger materials that might flow in to the system, materials such as small branches and the like. The fluid enters through pipe 25 and any debris is caught on a sloping filter or screen shown from the side as 26. The filtered or screened fluid then continues on through pipe 7 and into fluid receiving container 3. An optional man hole cover may 27 may also be included to access this inlet container to clean out filtered or screened debris, for example. Connections and supports may also be included as described in FIG. 3 to attach inlet container 24 properly to fluid receiving container 3 in a like fashion. Removing such debris helps maintain the system and reduce and possible plugging of the subsequent pumping operation within the fluid receiving container 3.

Figure 5:
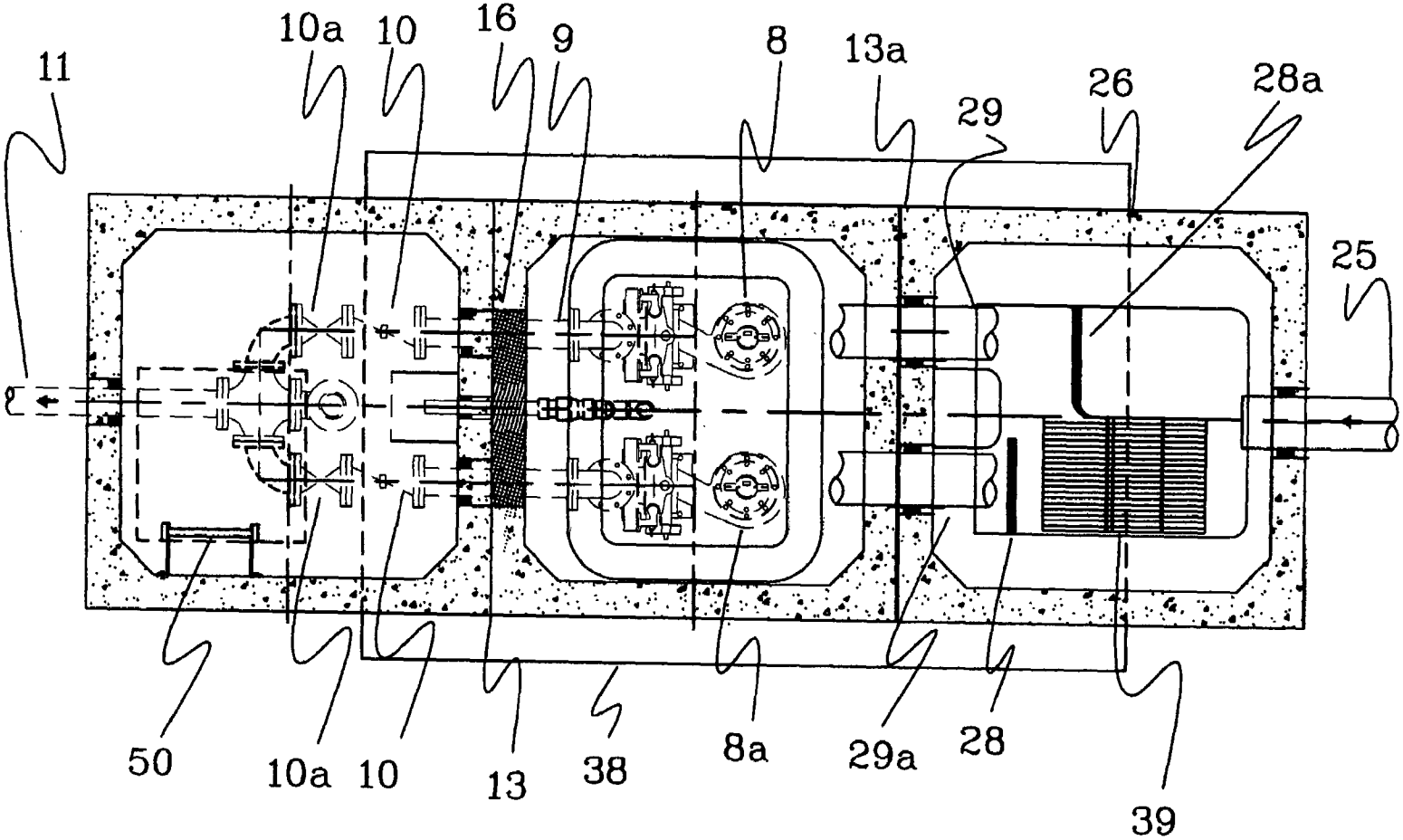
FIG. 5 is a top view of the elements from FIG. 4.

FIG. 5 is a top view of FIG. 4 in yet another embodiment showing a double submersible pump and a bar-screen system for filtering or screening out debris. In this figure, the fluid enters into an inlet container 26 through pipe 25. A bar-screen 26 is shown and a pair of baffle plates or bars as 28 and 28*a*. The screened or filtered fluid can then be passed via two pipes 29 and 29*a* into the fluid receiving container 3 and from thence by two submersible pumps (8 and 8*a*) in a pair of valves 10 and 10*a* located at an elevated level in valve container 4. From thence the fluid passes through pipe 11 on into the system.

Figure 6:
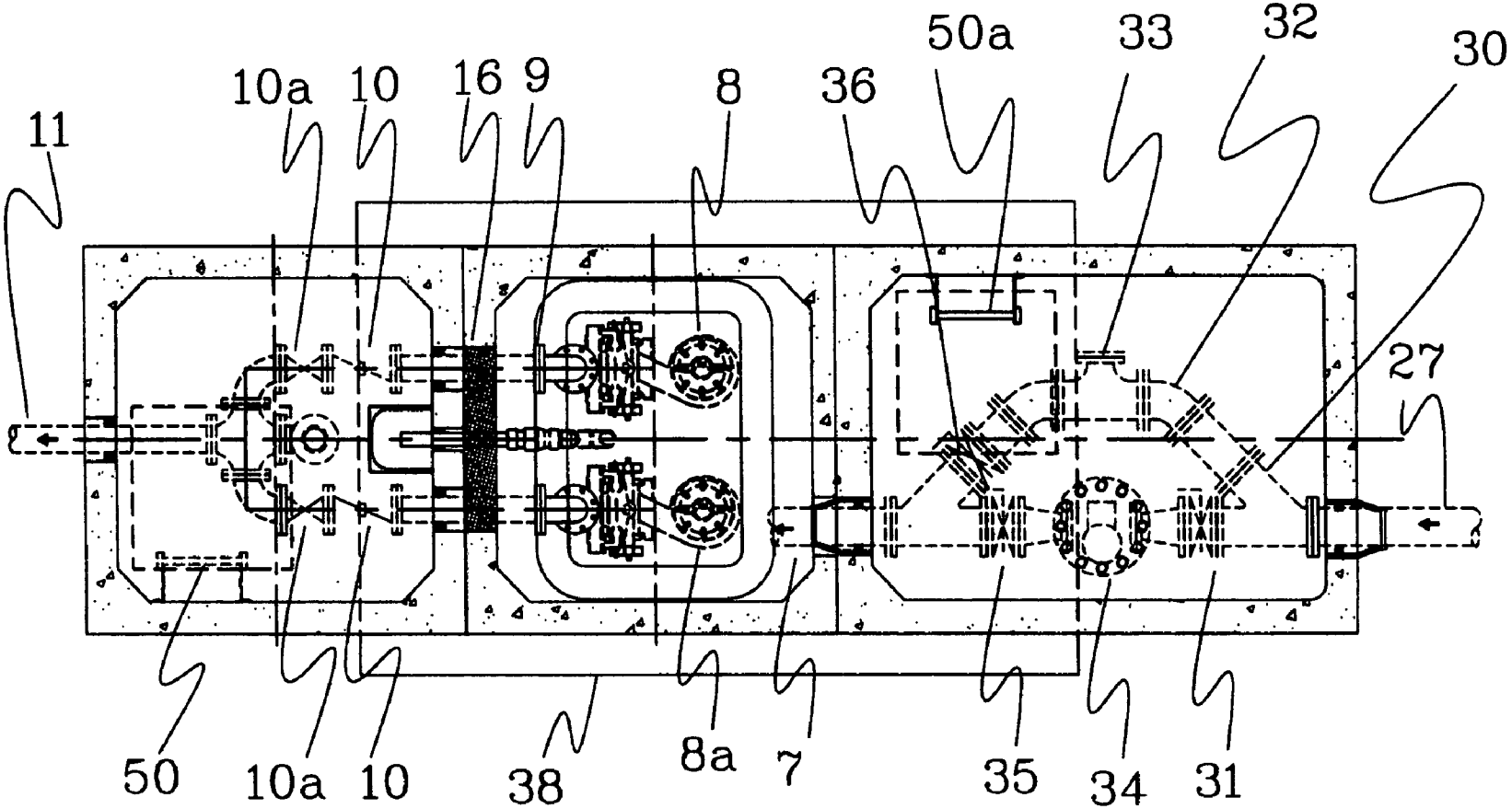
FIG. 6 is yet another embodiment of the design in FIG. 4 employing a macerating chamber in place of the catch container.

FIG. 6 shows a top view of FIG. 5 wherein a macerator replaces the filter or screen element and any solids that are present within the fluid are ground up so that they can pass through without damage to the following pump or pumps. In this showing 24 is the inlet container and the fluid enters through pipe 27 and exits into the fluid receiving container (not shown) through pipe 7. Inside this particular embodiment there is equipment requisite to macerating any solids that might be present within the entering fluid. This equipment comprises in order a "Y" pipe 30 one end of which leads to a valve 31. The other end of this "Y" leads through an elbow 32 to a flushing "T" 33. The macerator is shown as 34. Additional valves are shown in the system as 35 and 36. When valves 31 and 35 are open and valve 36 is closed, fluid goes through the macerator 34. When it flushing of the system is necessary, valves 31 and 35 are closed and valve 36 is opened and flushing of the system can occur through flushing "T" 33.

Figure 7:
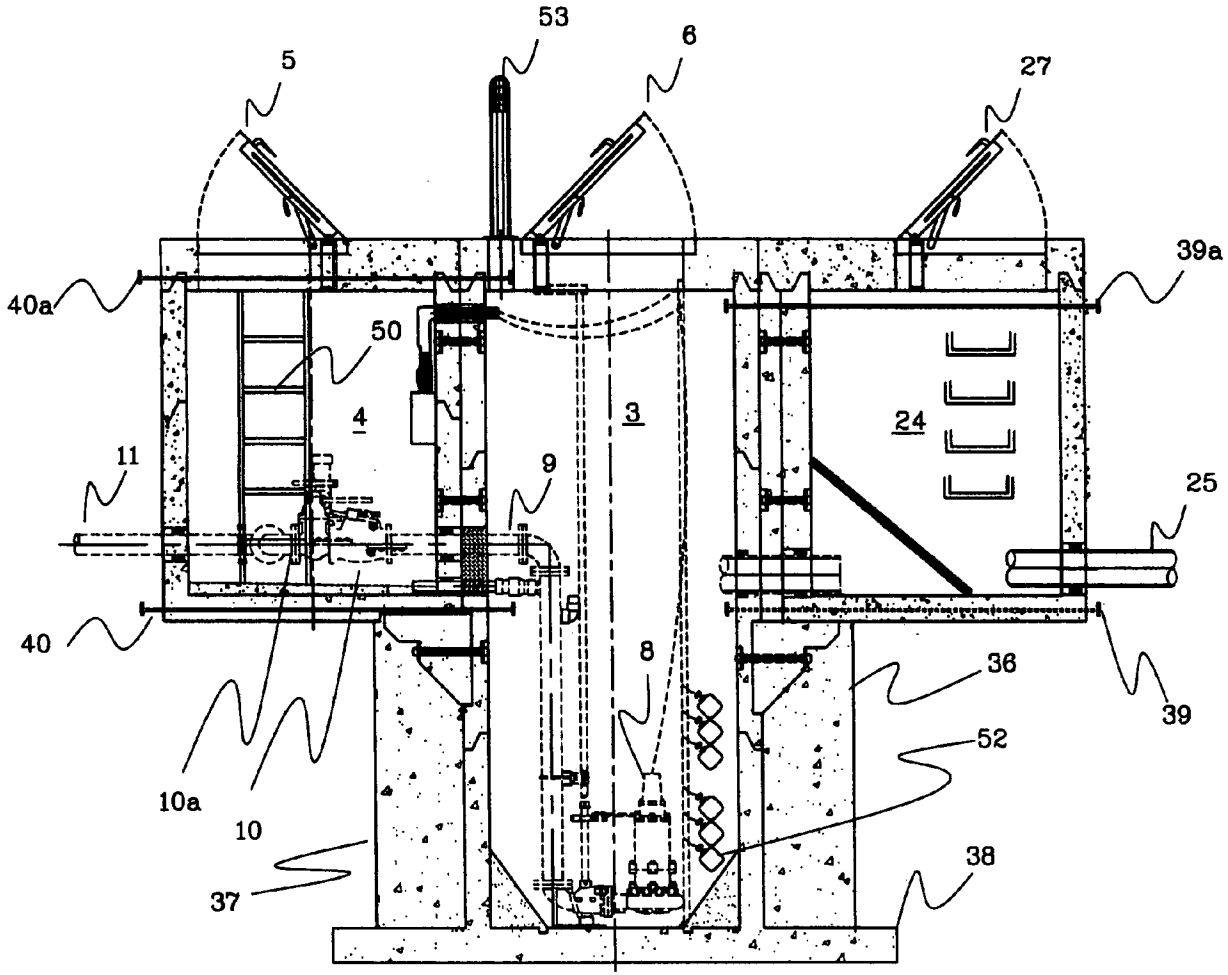
FIG. 7 shows a larger version of the element from FIG. 4 with some extra reinforcing elements in place.

FIG. 7 shows a larger version of the pumping station shown in FIG. 4 and all of the elements within that figure are here too. Since the system may be somewhat larger, optional supporting elements may be needed to ensure that the unitized structure, as installed, will sit safely under ground without significant movement or shifting of the various parts. Two additional supporting blocks 36 and 37 are shown placed under inlet trapping container 24 and valve container 4. The base 38 of the fluid receiving container 3 has been enlarged and two embedded tension cables 39 and 40 have been added.

Figures 8, 8A:
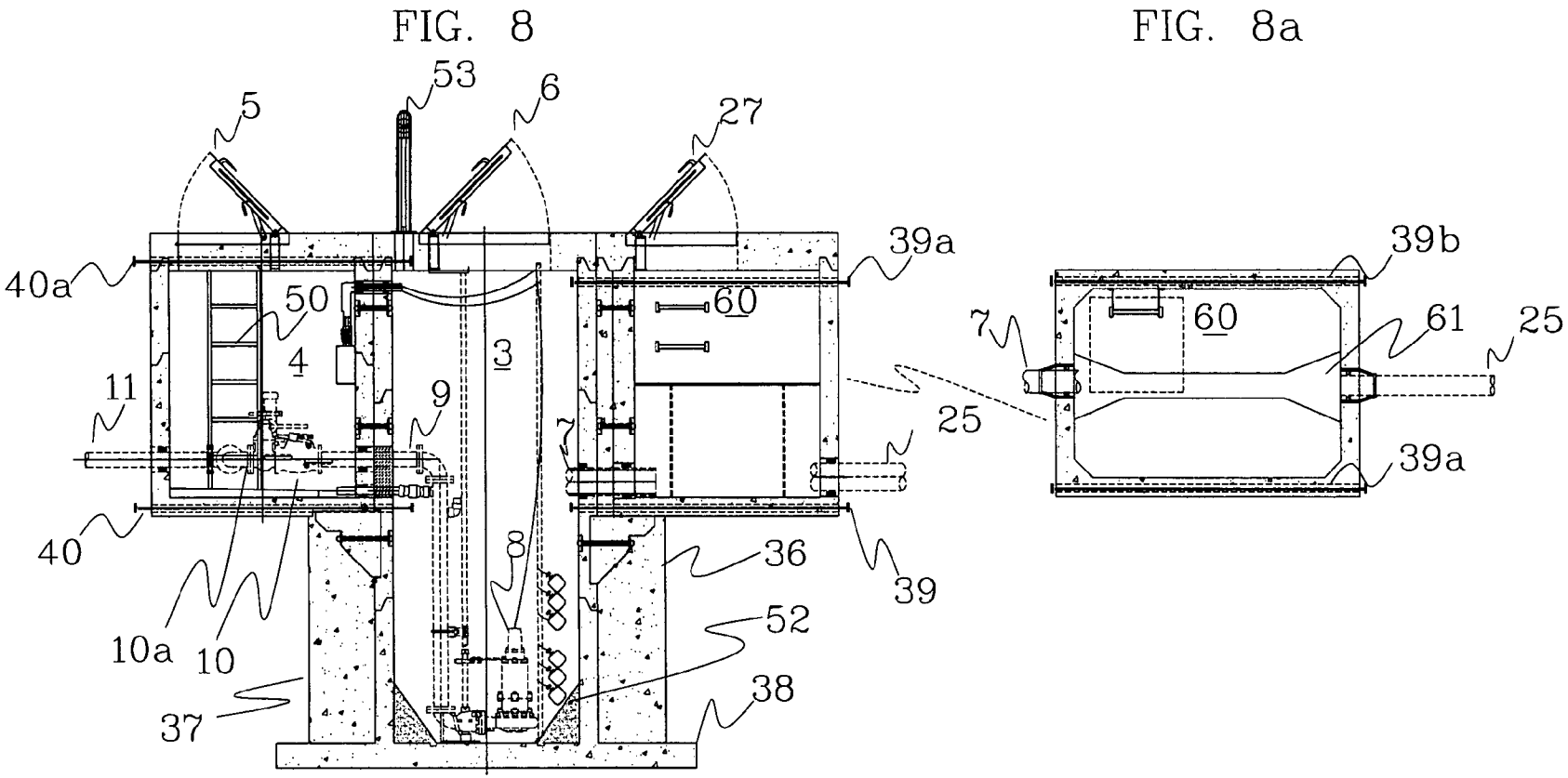

FIG. 8 is the same as FIG. 7 except that the inlet container has been replace by a flume chamber shown as 60. In FIG. 8*a* the flume chamber 60 is shown in a little more detail. This chamber (known as a Parshall Flume Chamber) contains flumes 61 and 62 and narrows down the flow of aqueous material coming in pipe 25 to aid in the measurement of that flow.

As noted previously, no one provides a suitable unitary structure (containing pumps, piping, vavling and optional screening and/or flow measurement devices) for pumping waste materials from one level to another. The prior art usually segregates the pumping container from the valve container and the pipe or line connecting these two containers can be severed or broken during the movement of the earth around the system. The inlet trap or flume chambers or containers are also installed separately and are separated from the pumping station itself. Additionally, the prior art usually offers round containers and these are more difficult to pre-cast and to store prior to installation, especially when mass produced. My novel and unique system offers squared, pre-cast, cementitious containers that are either connected at the factory or they can be assembled in situ to form the unitary structure described and shown in the drawings and figures attached hereto. My unique and novel design will withstand the strain and pressure of installation under streets and highways. The correct and universal term for this type of installation is commonly referred to as a Full Traffic Loading as defined by the American Association of State Highway and Transportation Officials and the rating they give for such installation is referred to as AASHTO (H-20) 16,000 lb. Wheel Loading. My novel structure will meet this definition.

The intent of this unique and novel structure is to act as a collection point in a gravity waste water or sewer system. All of the requisite elements to perform the task of pumping these materials from one level to another including the pumps, guide rail systems, valves and the like can be pre-installed within the pre-cast cementitious containers, taken to the site and then installed as one piece, for the smaller units, or, for the larger units, united together on the site together to form the unitary pumping station. As described, an optional auxiliary container or chamber can be offered and attached in a like manner to help with the flow of materials where excess or unusual solids may be present. These can be screened or filtered out or passed through a macerator system to grind them up suitable for passage through the pumping system. In addition, a flow monitoring device such as a Palmer-Bolus or Parshall Flume element may be included herein as shown in FIGS. 8 and 8*a*.

Conventionally, my novel unit is sectional as delivered to the site and cast from square sections of reinforced and pre-cast concrete having a minimum inside dimension of about 36" square to pieces as large as 144" square or whatever is practical to ship. Alternatively, smaller units can be furnished as a single piece. I prefer that the concrete used have a minimum, compressive strength of 6000 psi at 28 days and be reinforced with steel elements that meet ASTM A-615 Grade 60. Wall thickness should be about 6" at a minimum depending on the overall depth of installation of the unitary structure in the earth. Each portion of the pre-cast concrete as assembled should be of tongue and groove or shiplap shape and employ a two course field applied butyl rubber gasket system that seals via compression. Sealing between each of the containers should also be accomplished by the use of butyl rubber gaskets, specialized rubber links or non-shrink grouts, for example.

Although the specification and drawings contained herein show particularly preferred embodiments and showings of this invention other modifications to the connections and support systems, for example, may be envisioned within the metes and bounds therein. I do not feel limited to those particular elements and processes described.

I claim:

1. A unitary under ground pumping station pre-cast from cementitious material for moving aqueous waste materials from one level to another comprising in order, a. a squared fluid receiving container having a bottom with integral filets, four sides and a top with a first inlet line on one side, a first exit line on the side opposite to said first inlet and wherein said first exit and inlet lines are attached to a submersible pump contained within said fluid receiving container;

b. a smaller and squared valve container having a bottom, four sides, and a top wherein said top is essentially at the same level as said top from said receiving container and one of said sides mates with the side of said fluid receiving container having said first exit line thereon, and a second inlet line on one side, said second inlet line being attached to said first exit line side of said receiving container, and a second exit line wherein said second exit line in said valve container is on the side opposite to the side attached to said receiving container, a fluid transit line attached to said first exit line from said receiving container and to said second exit line in said valve container, and wherein said valve container also contains at least one valve within said fluid transit line, and wherein said valve container is attached to said fluid receiving container by mechanical means, so that when aqueous waste enters said receiving container and begins to fill up said receiving container, said pump will pump said aqueous waste up through said first exit line contained therein and through said fluid transit line and said valve and out said smaller container exit.

2. The pumping station of claim 1 wherein said attaching mechanical means consists essentially of a series of bolts cables, plates and other mechanical fasteners passing through both meeting sides of said containers and a gasket is placed between said sides to firmly mate said receiving container to said valve container.

3. The pumping station of claim 1 wherein manhole access and covers are present on the top of each container.

4. The pumping station of claim 1 wherein supporting blocks are installed under said valve container and said supporting blocks are attached to the meeting side of said fluid receiving container.

5. The pumping station of claim 1 wherein the top, sides and bottoms of both containers are at least 6 inches thick of cementitious material.

6. The pumping station of claim 1 wherein said cementitious material is concrete reinforced with steel and having a minimum compressive strength of 5000 psi at 28 days and said reinforced steel meets the limits set forth in ASTM A-615 Grade 60.

7. The pumping station of claim 1 wherein a bar-screening inlet container is added to said fluid receiving container on the side opposite to said valve container and a screen is present therein.

8. The pumping station of claim 7 wherein reinforcing concrete blocks are added under said valve container and said screening inlet container and tension cables attached between said valve container and said screening inlet container and said fluid receiving container.

* * * * *